US008220918B2

(12) United States Patent
Chappell et al.

(10) Patent No.: US 8,220,918 B2
(45) Date of Patent: Jul. 17, 2012

(54) SPREADER MODULE FOR DUPLEX CONTINUOUS FEED IMAGING DEVICES

(75) Inventors: James Michael Chappell, Webster, NY (US); Jason Matthew LeFevre, Penfield, NY (US); Paul John McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 417 days.

(21) Appl. No.: 12/643,184

(22) Filed: Dec. 21, 2009

(65) Prior Publication Data

US 2011/0149001 A1 Jun. 23, 2011

(51) Int. Cl.
*B41J 2/01* (2006.01)

(52) U.S. Cl. ..... 347/103

(58) Field of Classification Search ..... 347/88, 347/99, 103

See application file for complete search history.

(56) References Cited

U.S. PATENT DOCUMENTS

| | | | | |
|---|---|---|---|---|
| 5,563,695 | A * | 10/1996 | Sakurai et al. | 399/327 |
| 7,376,378 | B2 | 5/2008 | Van Bortel | |
| 2009/0009573 | A1 | 1/2009 | Larson | |
| 2009/0027436 | A1 | 1/2009 | McConville | |
| 2009/0141110 | A1 | 6/2009 | Gervasi | |
| 2009/0211521 | A1 | 8/2009 | Fioravanti | |

* cited by examiner

*Primary Examiner* — Omar Rojas

(74) *Attorney, Agent, or Firm* — Maginot, Moore & Beck, LLP

(57) ABSTRACT

A spreader module for use in an imaging device includes a housing configured for insertion and removal from a docking position of an imaging device frame, a spreader drum operably supported by the housing, and a pressure roller operably supported by the housing adjacent the spreader drum to define a spreading nip through which a web of media is fed. The spreader module includes a release agent application system supported by the housing for applying a first release agent to the spreader drum. A docking slot is positioned adjacent the pressure roll that is configured to releasably secure a release agent sub-module to the housing, the release agent sub-module for applying a second release agent to the surface of the pressure roller.

19 Claims, 7 Drawing Sheets

SPREADER MODULE FOR DUPLEX CONTINUOUS FEED IMAGING DEVICES

TECHNICAL FIELD

The present disclosure relates to ink-jet printing, particularly involving phase-change inks printing on a substantially continuous web.

BACKGROUND

In general, ink jet printing machines or printers include at least one printhead that ejects drops or jets of liquid ink onto a recording or image forming media. A phase change ink jet printer employs phase change inks that are substantially solid or gelatinous at ambient temperature, but transition to liquid at an elevated temperature. The molten ink can then be ejected directly onto a recording substrate, such as paper, (referred to as direct printing or direct marking), or onto an intermediate imaging member, such a drum or belt, for subsequent transfer to a recording substrate (referred to as offset printing).

In both the direct and offset printing architecture, images may be formed on cut media sheets or a very long, i.e., continuous, web of media. When using melted phase change ink to form images on a media, whether it be cut sheet or continuous web, the ink may be fixed to the media by the application of pressure and/or heat to the ink on the media. For example, after melted phase change ink is placed on media, the media may be guided to a fixing assembly that includes an image side roller for contacting the freshly deposited ink and a pressure roller leveraged against the image side roller to provide a pressurized nip through which the media is fed. As the media is fed through the nip, the image side roller presses the deposited ink against the media to take what are essentially isolated droplets of ink and smear them out to make a continuous layer so that spaces between adjacent drops are filled and image solids become uniform. In addition to spreading the ink, pressing the ink against the media in this manner may also improve image permanence by increasing ink layer cohesion and/or increasing ink-to-media adhesion. The image side roller, the pressure roller or both may be configured to heat the ink and web to enhance the ability of the ink to spread onto and adhere to the media.

Phase change ink web printers may be configured to print images onto a single side of the web, referred to herein as simplex printing, or onto both sides of the web, referred to herein as duplex printing. Duplex web printers may have, as examples, a serial web printing architecture or a mobius web printing architecture. In one type of serial architecture, a web of substrate material is guided through a first side print station for deposition of melted phase change ink onto a first side of the web and then guided through a pressurized nip of a first fixing assembly for spreading the ink and fixing the ink to first side of the web. The web may then be flipped over, or inverted, and guided through a second side print station for deposition of melted phase change ink onto the second side of the web. The web, after having been printed on the second side, is then guided through a pressurized nip of a second fixing assembly for spreading the ink and fixing the ink on the second side of the web. In a mobius arrangement, two strands of the same media web are fed side by side through a print station that is configured to print onto both of the strands simultaneously. The first side of the web is facing toward the print station for one of the strands, and the second side of the web is facing toward the print station for the other strand. After the two strands have been printed onto at the print station, both strands are fed through the pressurized nip of a fixing assembly. The strand with the first side of the web facing toward the print station is guided to the entrance of the print station to serve as the second strand of the web and inverted along the way so that the second side of the web is facing toward the print station.

One difficulty faced in duplex printing is damage to the fixed ink on the first side of the media while fixing ink to the second side of the media. For example, when fixing the ink on the second side of the web, the fixed ink on the first side of the web is contacted by the pressure roller. Depending on the temperature and pressure in the nip, the fixed ink may offset to the pressure roller resulting in degradation of the images on the first side of the media. To prevent ink offset to the pressure roller while duplex printing on cut sheets, the pressure roller is allowed to scavenge some of the release agent from the image side roller during the intermittent contact with the image side roller between the passages of sheets. In web printing, however, the web acts as a constant barrier between the image side roller and the pressure roller of a fixing assembly.

To prevent ink offset to the pressure roller in duplex web printers, previously known duplex printers have decreased the temperature setpoints of the print process components relative to cut sheet printers so that the web is at a lower temperature when entering the pressurized nip of the fixing assembly. The lower temperature of the ink entering the nip decreases the malleability of the melted phase change ink and, therefore, reduces the propensity of the ink to offset to the pressure roller. The lower temperature of the ink entering the nip, however, necessitates an increase in the pressure in the nip in order to maintain the same degree of ink spread and corresponding image quality. The increased pressure requirements at the fixing nip in turn increases the wear on the image side roller and pressure roller which decreases the usable life of the rollers.

SUMMARY

To address the problems associated with ink offset to the pressure roller of a spreader in duplex printing, a spreader module has been developed that enables the spreader module to be easily adapted to include a release agent application system for the pressure roller of the spreader module. The spreader module includes a housing configured for insertion and removal from a docking position of an imaging device frame, a spreader drum operably supported by the housing, and a pressure roller operably supported by the housing adjacent the spreader drum to define a spreading nip through which a web of media is fed. The spreader module includes a release agent application system supported by the housing for applying a first release agent to the spreader drum. A docking slot is positioned adjacent the pressure roll that is configured to releasably secure a release agent sub-module to the housing, the release agent sub-module for applying a second release agent to the surface of the pressure roller.

In another embodiment, an imaging device is provided that includes a frame having a web transport system for transporting a continuous web of media along a web path and a spreader module docking position. At least one printhead is mounted to the frame adjacent the web path and configured to deposit melted phase change ink onto the web to form images thereon. A spreader module installed in the spreader module docking position. The spreader module includes a housing in which are supported a spreader drum and a pressure roller arranged adjacent the spreader drum to define a spreading nip through which the web is fed. The housing also includes a release agent application system for applying a first release agent to the spreader drum and a docking slot positioned adjacent the pressure roll. The docking slot is configured to releasably secure a release agent sub-module to the housing, the release agent sub-module for applying a second release agent to the surface of the pressure roller.

DETAILED DESCRIPTION

Figure 1:
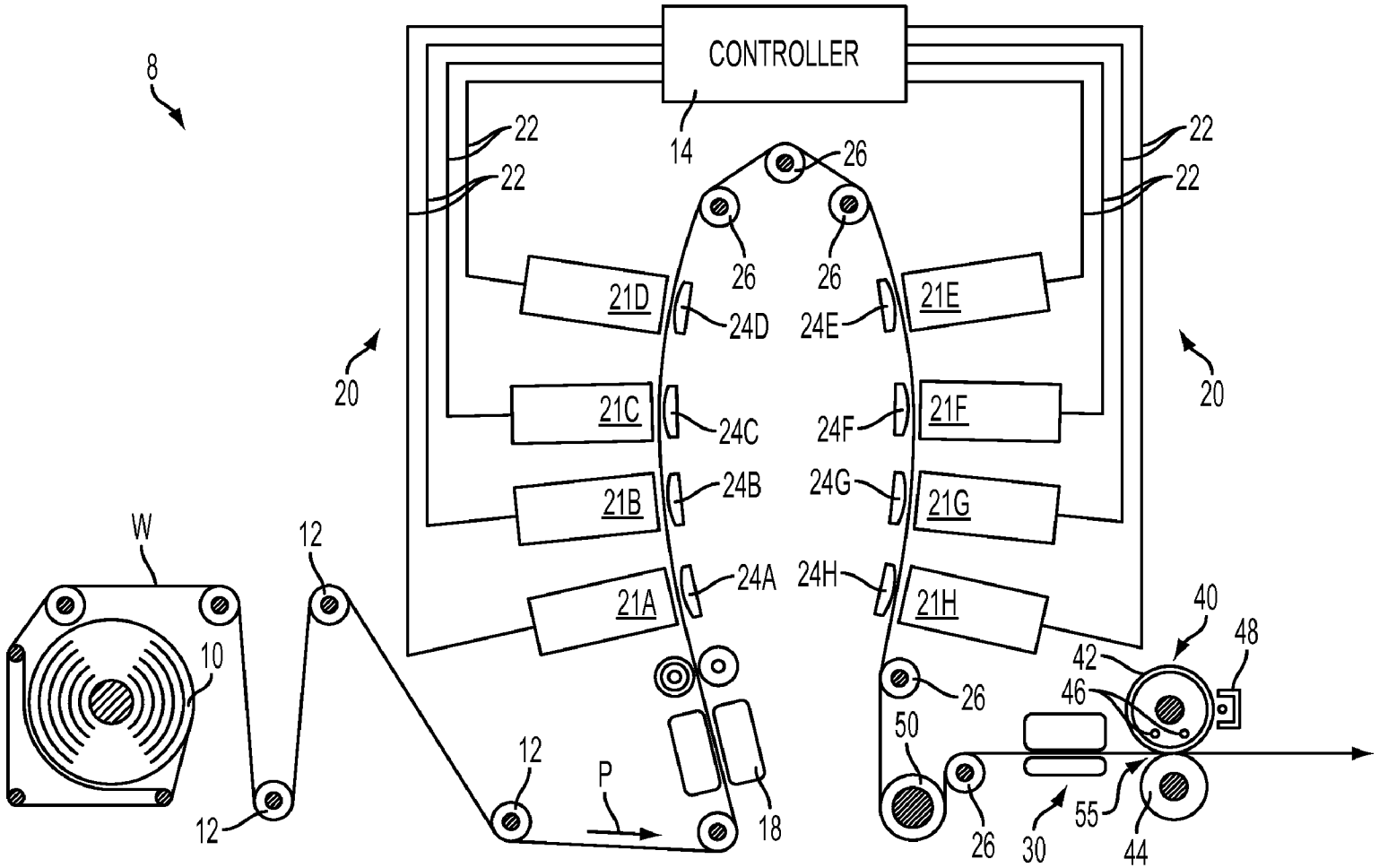
FIG. 1 is a simplified elevational view of a direct-to-web, continuous-web, phase-change ink printer.

For a general understanding of the present embodiments, reference is made to the drawings. In the drawings, like reference numerals have been used throughout to designate like elements.

As used herein, the term "imaging device" generally refers to a device for applying an image to print media. "Print media" may be a physical sheet of paper, plastic, or other suitable physical print media substrate for images, whether precut or web fed. The imaging device may include a variety of other components, such as finishers, paper feeders, and the like, and may be embodied as a copier, printer, or a multi-function machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which an image receiving surface, e.g., media sheet or web, or intermediate transfer drum or belt, onto which the image is transferred moves through the imaging device. The cross-process direction, along the same plane as the image receiving surface, is substantially perpendicular to the process direction.

FIG. 1 is a simplified elevational view of a direct-to-sheet, continuous-web, phase-change ink printer 8. A web supply and handling system is configured to supply a very long (i.e., substantially continuous) web W of "substrate" (paper, plastic, or other printable material) from a spool 10. The web W may be unwound as needed, and propelled by a variety of motors, not shown. The web supply and handling system is capable of transporting the web W at a plurality of different speeds. A set of rolls 12 controls the tension of the unwinding web as the web moves through a path.

Along the path there is provided preheater 18 configured to bring the web to a target preheating temperature for printing, which in one practical embodiment, depending on the media type and ink formulation, is in a range of about 30° C. to about 70° C. The preheater 18 can rely on contact, radiant, conductive, or convective heat to bring the web W to the target preheat temperature.

After the preheater 18, the web W moves through a print zone 20 including a series of printheads 21A-21H, each printhead effectively extending across the width of the web and being able to place ink of one primary color directly (i.e., without use of an intermediate or offset member) onto the moving web. Eight printheads are shown in FIG. 1 although more or fewer printheads may be used. As is generally familiar, each of the four primary-color images placed on overlapping areas on the web W combine to form color images, based on the image data sent to each printhead through image path 22 from print controller 14. In various possible embodiments, there may be provided multiple printheads for each primary color; the printheads can each be formed into a single linear array. The function of each color printhead can be divided among multiple distinct printheads located at different locations along the process direction; or the printheads or portions thereof can be mounted movably in a direction transverse to the process direction P, such as for spot-color applications.

Operation and control of the various subsystems, components and functions of the machine or printer 8 are performed with the aid of the controller 14. The controller 14 may be a self-contained, dedicated mini-computer having a central processor unit (CPU), electronic storage, and a display or user interface (UI) (not shown). The controller 14 receives and manages image data flow between image input sources (not shown), which may be a scanning system or an online or a work station connection, and the printheads. The controller generates control signals that are delivered to the components and subsystems. These control signals, for example, include drive signals for actuating the ink jets of the printheads to eject drops in timed registration with each other and with the movement of the web W to form images thereon.

In one embodiment, the marking media applied to the web is a "phase-change ink," by which is meant that the ink is substantially solid or gelatinous at room temperature and substantially liquid when heated and initially jetted onto the web W. Currently-common phase-change inks are typically heated to about 100° C. to 140° C., and thus in liquid phase, upon being jetted onto the web W. Generally speaking, the liquid ink cools down quickly upon hitting the web W.

Each printhead may have a backing member 24A-24H, typically in the form of a bar or roll, which is arranged substantially opposite the printhead on the other side of web W. Each backing member is used to position the web W so that the gap between the printhead and the sheet stays at a known, constant distance. Each backing member can be controlled to cause the adjacent portion of the web to reach a predetermined "ink-receiving" temperature, in one practical embodiment, of about 40° C. to about 60° C. In various possible embodiments, each backing member can include heating elements, cavities for the flow of liquids therethrough, etc.; alternatively, the "member" can be in the form of a flow of air or other gas against or near a portion of the web W. The combined actions of preheater 18 plus backing members 24 held to a particular target temperature effectively maintains the web W in the printing zone 20 in a predetermined temperature range of about 40° C. to 70° C.

As the partially-imaged web moves to receive inks of various colors throughout the printing station 20, the temperature of the web is maintained within a given range. Ink is jetted at a temperature typically significantly higher than the receiving web's temperature which heats the surrounding paper (or whatever substance the web W is made of). Therefore the members in contact with or near the web in zone 20 must be adjusted so that that the desired web temperature is maintained. For example, although the backing members may have an effect on the web temperature, the air temperature and air flow rate behind and in front of the web may also impact the web temperature. Accordingly, air blowers or fans may be utilized to facilitate control of the web temperature.

The web temperature is kept substantially uniform for the jetting of all inks from printheads in the printing zone 20. This uniformity is valuable for maintaining image quality, and particularly valuable for maintaining constant ink lateral spread (i.e., across the width of web W, such as perpendicular to process direction P) and constant ink penetration of the web. Depending on the thermal properties of the particular inks and the web, this web temperature uniformity may be achieved by preheating the web and using uncontrolled backer members, and/or by controlling the different backer members 24A-24H to different temperatures to keep the substrate temperature substantially constant throughout the printing station. Temperature sensors (not shown) associated with the web W may be used with a control system to achieve this purpose, as well as systems for measuring or inferring (from the image data, for example) how much ink of a given primary color from a printhead is being applied to the web W at a given time. The various backer members can be controlled individually, using input data from the printhead adjacent thereto, as well as from other printheads in the printing station.

Following the print zone 20, along the path of web W, is a "spreader" 40, that applies a predetermined pressure, and in some implementations, heat, to the web W. The function of the spreader 40 is to take what are essentially isolated droplets of ink on web W and smear them out to make a continuous layer by pressure, and, in one embodiment, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes a spreader roll 42, or drum, and a pressure roller 44 that are arranged with respect to each other to define a spreading nip 55 through which the web is fed.

For optimum spreader performance, ink and web temperatures should be substantially uniform prior to entering the spreading nip 55 and be at a target temperature or within a target temperature range that promotes adherence of the melted ink to the web, minimizes "show through" of the ink through the web, and maximizes ink dot spread. The target temperature and the target temperature range for the ink and web temperatures prior to entering the spreading nip 55 may also be referred to as the spreading temperature or spreading temperature range (explained below). In addition, the process of bringing the ink and web temperatures to the spreading temperature or spreading temperature range may also be referred to as equalization of the ink and web temperatures. In one embodiment, the spreading temperature may be any temperature between approximately 30° C. and approximately 80° C., and, in one particular embodiment, is approximately 55° C. The spreading temperature or temperature range, however, may be any suitable temperature or range of temperatures depending on a number of factors such as the ink formulation, web substrate material, web velocity, and the like.

In order to equalize the ink and web temperatures at the target spreading temperature, a temperature leveling roller 50 and/or one or more midheaters 30 are positioned along the media path following the print station 20 to equalize the web and ink temperatures and to bring the web and ink temperatures to a target temperature for spreading prior to being fed through the spreading nip. The leveler roller 50 is a temperature controlled, thermally conductive roller designed to operate at a target temperature to equalize the incoming ink and web temperatures. The leveler roller 50 may be formed of a thermally conductive material, such as aluminum, although the core may be made of other suitable materials, such as iron, nickel, stainless steel, and various synthetic resins. The development of thermal energy in the leveler roller 50 may be accomplished in any suitable manner. For example, the leveling roller may include heating and/or cooling elements (not shown) for maintaining the surface of the leveler roller at the desired operating temperature.

During operation, as the web is moved along the web path, the web W is wrapped partially around the leveler roller 50 as seen in FIG. 1. The length of the web that contacts the leveler roller 50 is referred to herein as the wrap length, or contact length. Contact between the higher ink and web temperature with the lower temperature of the leveler roller 50 causes conductive heat transference to occur between the web and the leveler roller thereby lowering the temperature of the ink and web toward the operating temperature of the leveler roller. The extent to which the ink and web temperatures may be equalized, or leveled, is generally a function of the temperature of the leveler roller 50, and the length of time, or dwell time, that the web W remains in contact with the leveler roller. As used herein, dwell time refers to the maximum amount of time that any given point on the web remains in contact with the leveler roller. Dwell time between the web and the leveler roller is dependent upon the speed that the web is moving and the wrap length, or contact length, between the web and the leveler roller. The wrap length at which the web is in contact with the web may be any suitable wrap length that is capable of creating adequate dwell time to level the ink and web temperatures in light of the web speed and operating temperature of the leveler roller.

One or more midheaters 30 are positioned along the media path downstream from the leveler roller 50, i.e., after the leveler roller in the process direction P of the media, to heat the equalized ink and web temperatures to a target temperature for spreading. Midheaters 30 can use contact, radiant, conductive, and/or convective heat to bring the media W to a target temperature. The midheaters 30 bring the ink placed on the media to a temperature suitable for desired properties when the ink on the media is sent through the spreading nip. In one embodiment, a useful range for a target temperature for ink entering the spreading nip is about 35° C. to about 80° C., and in one particular embodiment is approximately 55° C.

Figure 2:
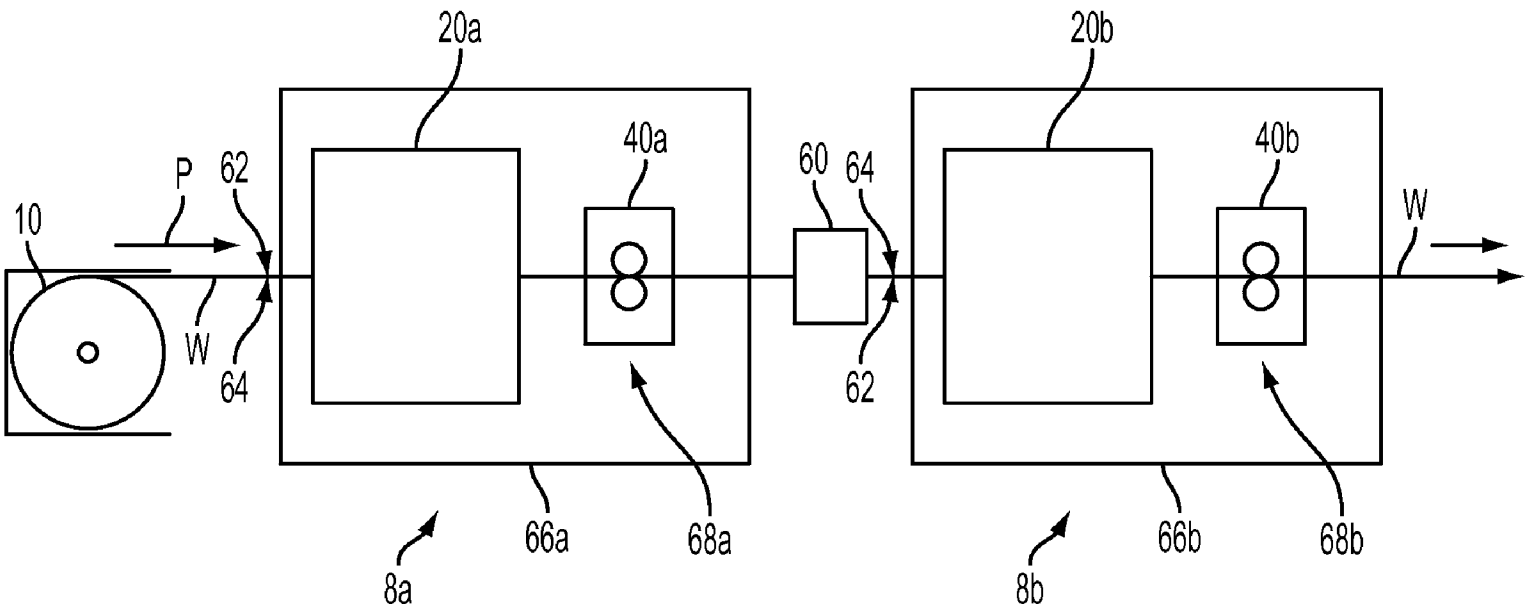
FIG. 2 is a schematic diagram of a serial duplex printing arrangement that utilizes the imaging device of FIG. 1.

Imaging devices such as the imaging device of FIG. 1 may be used to form images on one side of the web, referred to herein as simplex printing, or both sides of the web, referred to herein as duplex printing. As mentioned, web printers may have a serial web printing arrangement or a mobius web printing arrangement. An example of a serial duplex printing arrangement is depicted in FIG. 2. The exemplary serial arrangement of FIG. 2 includes a first imaging device 8*a* and a second imaging device 8*b* arranged in sequence with an inversion system 60 positioned therebetween. During operation, a web W of substrate material is guided from a web source, such as spool 10, through the first imaging device 8*a* for deposition of ink onto a first side 62, or simplex side of the web, and then guided through the spreading nip of the spreader 40*a* of the first imaging device 8*a*, i.e., the first spreader, for spreading the ink and fixing the ink to the simplex side of the web. The inversion system 60 is positioned downstream from the first spreader 40*a* that is configured to flip or invert the web W so that the second side 64, or duplex side, of the web is facing the appropriate direction for the deposition of ink thereon in the second imaging device 8*b*. The web, after having been printed on the duplex side, is then guided through the spreading nip of the spreader 40*b* of the second imaging device 8*b*, i.e., the second spreader, for spreading the ink on the duplex side 64 and fixing it to duplex side of the web.

Figure 3:
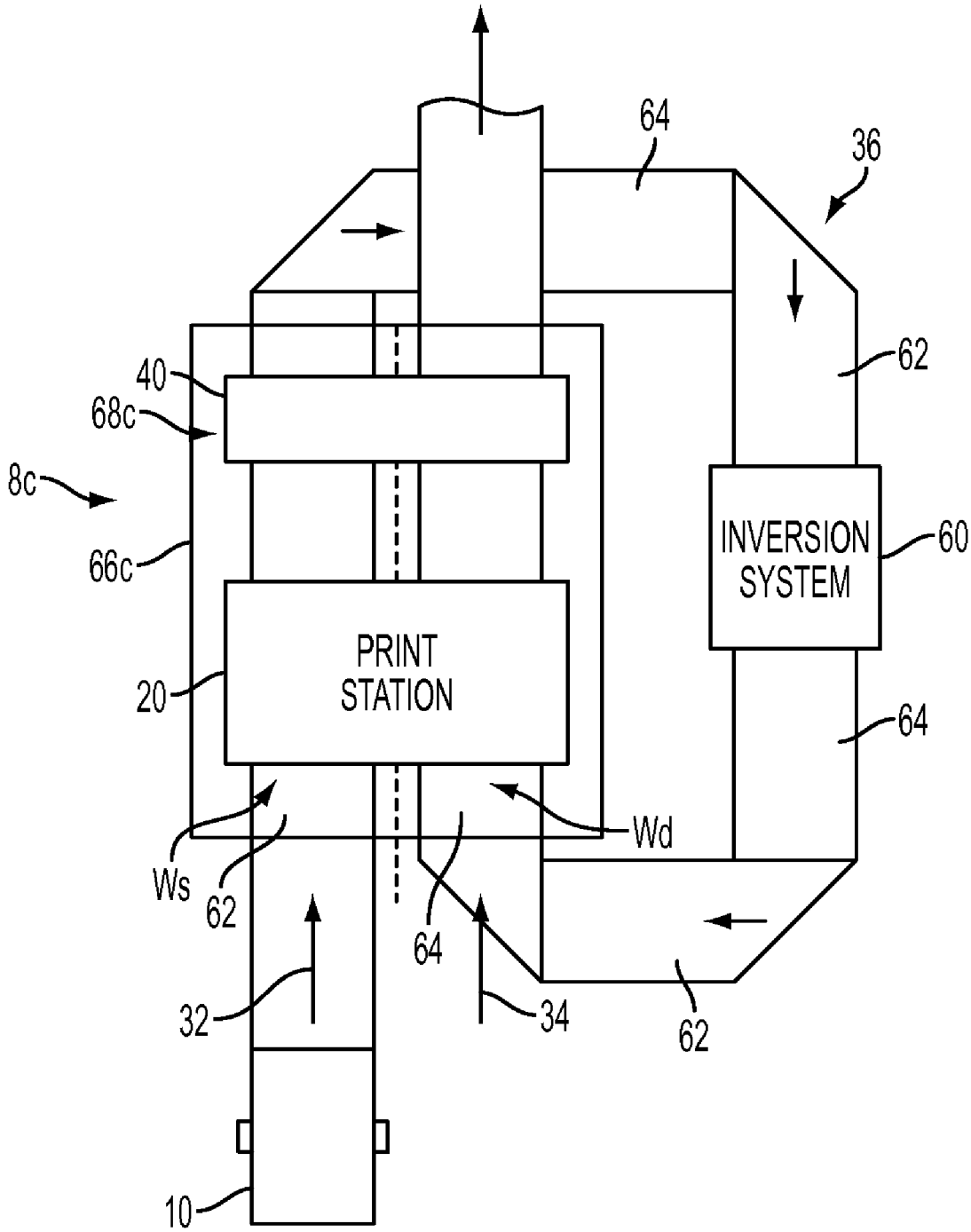
FIG. 3 is a schematic diagram of a mobius duplex printing arrangement that utilizes the imaging device of FIG. 1.

FIG. 3 shows a mobius duplex web printing arrangement that may be implemented using an imaging device 8*c* which is similar to the imaging device 8 of FIG. 1. As depicted in FIG. 3, the mobius arrangement includes a dual width, or dual path, transport system that is configured to transport two lengths or strands of the web, $W_S$ and $W_D$, along parallel web paths 32 and 34 through the print station 20 and a spreader module 40 simultaneously. The web of media in this embodiment may be narrower in the cross-process direction than the web used in the serial arrangement so that the dual paths 32, 34 may be accommodated in a standard width architecture. Alternatively, the transport system and systems, such as the print station 20 and spreader 40, of the imaging device 8*c* may be widened to accommodate two standard width strands of media.

As depicted in FIG. 3, a first path 32 of the web transport system is configured to transport a portion of the web $W_S$ with one of the surfaces, i.e., simplex surface, 62 of the web facing in a direction to be printed upon by the printheads of the print station 20. The second path 34 of the web transport system is configured to transport a portion of the web $W_D$ with the opposite surface, i.e., the duplex surface 64, of the web facing the print station. The web transport system is configured to transport the strands through the print station 20. The print station 20 includes print units (not shown in FIG. 5) that are configured to deposit ink onto both lengths of the web $W_S$ and $W_D$ to form images on both the simplex and duplex side of the web. After traveling through the print station 20, the web lengths $W_S$ and $W_D$ are guided through the spreader module 40 which is configured to spread the ink deposited onto the web lengths $W_S$ and web length $W_D$ simultaneously. After being fed through the spreader 40, the first path 32 directs the web $W_S$ to a return path 36 along which is positioned an inversion system 60 that inverts the web. The inverted web is then guided along the return path to the entrance of the second path 34 so that the duplex side 64 is facing the print station 20.

As mentioned above, one difficulty faced in duplex printing on a continuous web is the offsetting of the fixed ink on the simplex side of the web to the pressure roller when the simplex side of the web is contacted by the pressure roller in the spreading nip. To prevent such offset, some previously known systems have lowered the temperature setpoints of the print process components such as the target temperatures for the leveling module, midheating modules, and the spreader module. The lower setpoint temperatures decreased the ability of ink to offset to the pressure roller in the second spreader. The lower setpoint temperatures, however, necessitated an increase in the pressure applied to the web in the spreading nip in order to maintain the same line spread which decreases the life of the pressure roller.

As an alternative to lowering temperature setpoints to prevent ink offset, a spreader module has been developed that includes a release-agent sub-module for applying release agent to the pressure roller of the spreader module, or at least to portions of the pressure roller that contact ink. As used herein, a module refers to a replaceable unit for performing a particular task in the printer that is provided with any and all of the necessary devices and mechanisms for performing that task and a housing or frame for supporting the devices and mechanisms in a manner that enables them to be installed and removed from the printer as a single unit. The use of replaceable modules for the various systems and subsystems of the imaging device facilitate the assembly and/or reconfiguration of the imaging device as well as the repair and/or replacement of the various systems and devices.

The release agent sub-module and corresponding spreader module are configured so that the release agent sub-module may be quickly and easily installed or removed from the spreader module. Such a configuration enables an imaging device, such as imaging device 8*b* of FIG. 2 and imaging device 8*c* of FIG. 3 to be adapted for duplex printing by simply installing a release agent sub-module in the associated spreader module. The release agent sub-module does not have to be installed in spreader modules of simplex printers or for the first printer 8*a* in a serial duplex architecture which saves costs. As explained below, the release agent sub-module includes an applicator for applying release agent to the pressure roller surface. The release agent applicator is configured to apply release agent to the entire pressure roller surface when used in the spreader module of the second imaging device in a serial arrangement such as depicted in FIG. 2. When used in the spreader module of a mobius printer such as depicted in FIG. 3, the release agent applicator is configured to apply release agent to only a predetermined portion of the pressure roller surface, i.e., the portion of the pressure roller that is in the path of web strand $W_D$.

The use of release agent on the pressure roller enables the ink and web to be hotter entering the spreading nip relative to previously known systems while avoiding ink offset to the pressure roll. For example, the use of release agent on the pressure roll enables the ink temperature to be in a range from between approximately 57° C. and approximately 80° C. The increased temperature of the ink entering the spreader enables a corresponding decrease in the pressure required for the spreading nip, e.g., approximately 10%-40%. In one embodiment, the pressure required for the spreading nip with release agent on the pressure roll based on an incoming ink temperature of approximately 65° C. is approximately 1000 psi.

To enable the use of replaceable modules, imaging devices, such as the imaging devices of FIGS. 1-3, include a frame 66 having a plurality of module or device slots, also referred to as docking positions, to which the various component modules, and other devices, such as web transport devices, may be operably and releasably secured. Accordingly, as depicted in FIGS. 2 and 3, the frames 66*a*, 66*b*, and 66*c* of the imaging devices include a dedicated docking position 68*a*, 68*b*, and 68*c* for the spreader modules that enables the spreader modules 40 to be releasably secured to the frames 66*a*-*c* in an operative position along the web path.

Figure 4:
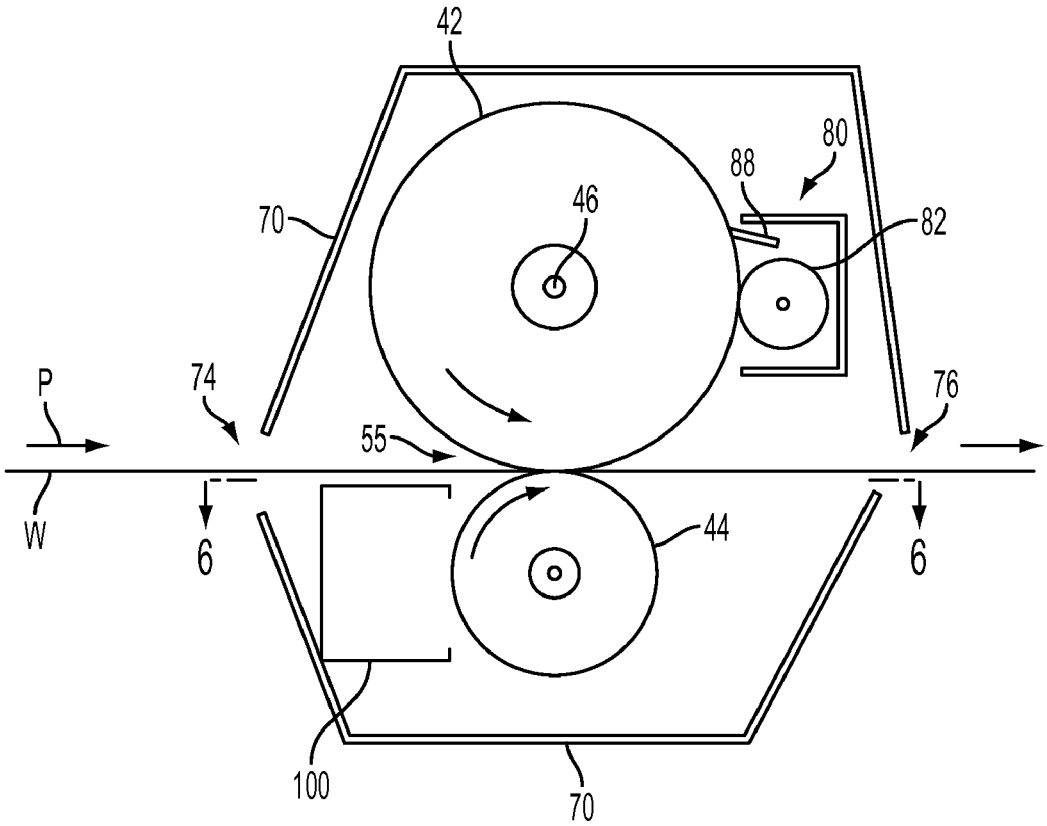
FIG. 4 is a schematic cross-sectional view of an embodiment of a spreader module for use with the imaging device of FIG. 1.

As depicted in FIG. 4, the spreader module 40 includes a housing or frame 70 in which the spreader drum 42 and pressure roll 44 are operably supported. The housing 70 includes an inlet opening 74 through which the web W enters and an outlet opening 76 through which the web W exits. The housing 70 positions the spreader drum 42 and the pressure roll 44 with respect to each other to define the spreading nip 55 between the inlet 74 and outlet openings 76 through which the web W is fed. The surface of the spreader drum 42 is positioned to contact the side of the web printed on by the corresponding print station and is formed of a suitable hard material, such as anodized aluminum. The surface of the pressure roller 44 is positioned to contact the opposite side of the web W from the spreader drum 42. The pressure roller 44, or at least an outer layer of the pressure roller, may be formed of an elastomeric material with a durometer anywhere from about 50 D to about 65 D, with elastic modulii from about 65 MPa to about 115 MPa. In various practical applications, elastomeric or rubbery pressure rolls of one or more layers, with effective elastic modulii from about 50 MPa to about 200 MPa, can be provided. Either the spreader drum or the pressure roller can include heat elements 46 for heating the corresponding drum or roller to bring the web W to a temperature in a range from about 35° C. to about 80° C.

The spreading nip 55 is defined as the contact region between the spreader drum 42, pressure roller 44, and web W, and is the region in which the pressure roller 44 compresses the media W against the spreader drum 42. The pressure roller 44 is operably coupled to a positioning system (not shown) that is configured to leverage the pressure roller 44 against the spreader drum 42 to provide a predetermined amount of pressure in the spreading nip 55. Pressure sensors (not shown), such as a strain gauge, may be associated with the pressure roller to provide an indication of the pressure being exerted by the pressure roller 44 against the spreader drum 42. The pressure(s) indicated by the pressure sensors may be provided as an input to a controller (not shown in FIG. 4) to use as feedback for controlling the positioning mechanism to provide the desired pressure in the spreading nip 55. The nip pressure at the spreading nip 55 is selected based on the temperature of the ink entering the spreader, and, in one practical embodiment, may be in a range of about 500 psi to about 2000 psi although any suitable spreading nip pressure may be utilized.

As seen in FIG. 4, the spreader module 40 includes a release agent application system 80 for applying release agent to the surface of the spreader drum 42 to prevent ink from offsetting to the spreader drum 42 in the spreading nip 55. As the web W is guided through the spreading nip 55, the ink on the web contacts the release agent and is prevented from offsetting or adhering to the spreader drum 42. The release agent application system 80 includes an applicator 82 for applying the release agent to the spreader drum. The release agent applicator may receive release agent by absorbing release agent from a sump (not shown) or release agent may be pumped to the applicator from a reservoir (not shown). The release agent is typically silicone oil although any suitable release agent may be used. A metering blade 88 may be provided for metering the release agent onto the drum 42 at a predetermined rate. The release agent application system 80 for the spreader drum is configured to supply release agent to the spreader drum for the life of the spreader, and therefore, may be provided as a permanent fixture of the spreader module 40.

Figure 5:
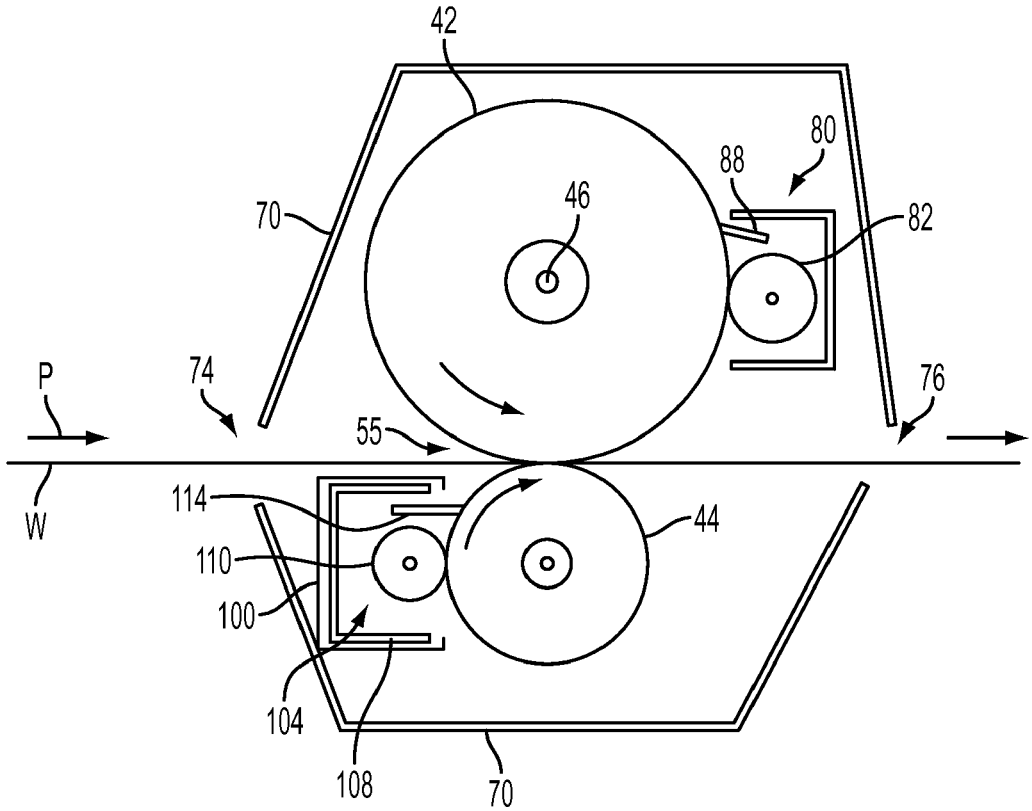
FIG. 5 is a schematic cross-sectional view of the spreader module of FIG. 4 with a release agent sub-module installed therein.

To adapt the spreader module 40 for duplex printing, the spreader module frame 70 is provided with a docking position, or slot, 100 into which a release agent sub-module 104 (FIG. 5) may be releasably secured. As used herein, a "sub-module" is a replaceable unit for performing a particular task as part of a module and includes some or all of the necessary devices and mechanisms for performing that task, and a housing or frame for supporting the devices and mechanisms in a manner that enables them to be installed and removed from the module as a single unit. FIG. 5 shows the spreader module 40 with a release agent sub-module 104 installed in the docking slot 100 of the spreader module 40. The release agent sub-module 104 includes a housing or frame 108 in which the components of the sub-module 104 are operably secured. The spreader module frame 70 and/or the release agent sub-module frame 108 may be provided with suitable attachment features (not shown), such as fastening mechanisms, latches, positioning guide features, and the like, to position the release agent sub-module 104 in the correct position with respect to the pressure roller 44 of the spreader module 40. The exact method of releasably securing the release agent sub-module 104 to the spreader module 40 is not critical and any suitable method may be used.

As depicted in FIG. 5, the release agent sub-module housing 108 includes a release agent applicator 110 for applying release agent to the surface of the pressure roller 44. The release agent may be the same as or different from the release agent used for the spreader drum 42. The release agent for the pressure roll 44 is configured to prevent ink that has already been fixed to the web from adhering to the roll surface whereas the release agent for the spreader drum is configured to prevent malleable, un-spread ink from offsetting the spreader drum. The lesser requirements for the release agent for the pressure roll may allow a less expensive release agent to be used to in the sub-module 104.

Figure 6:
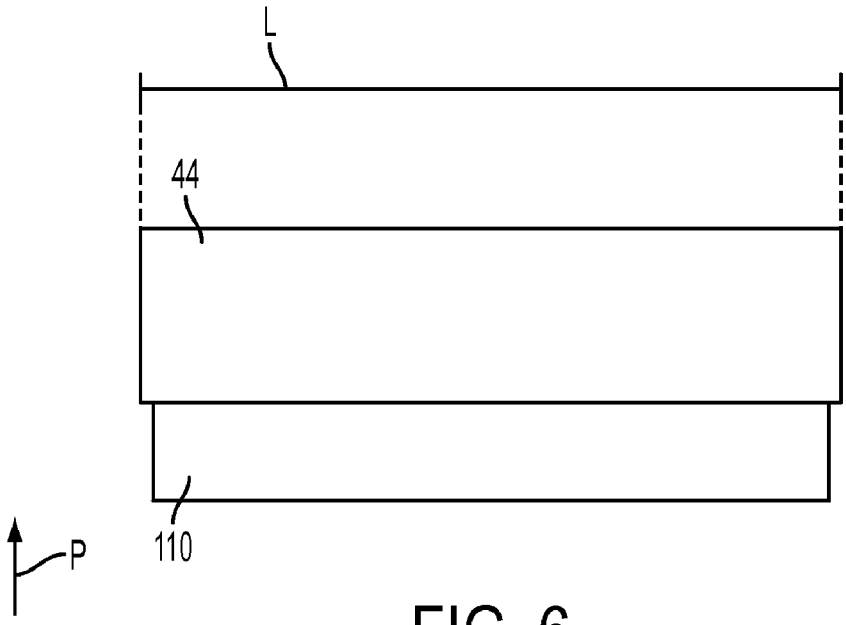
FIG. 6 is a schematic front view of one embodiment of a release agent applicator for use with the release agent sub-module of FIG. 5.
Figure 7:
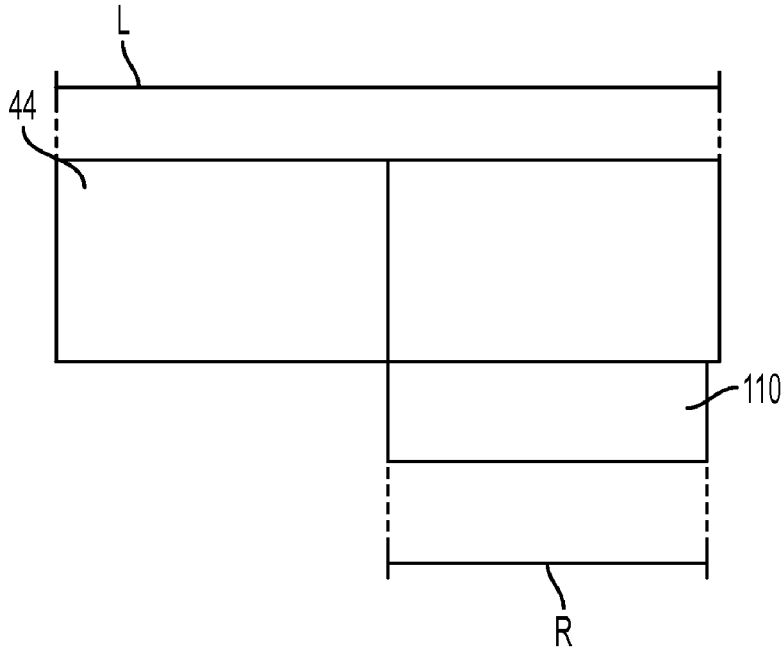
FIG. 7 is a schematic front view of another embodiment of a release agent applicator for use with the release agent sub-module of FIG. 5.

As depicted in FIG. 6, the release agent applicator 110 may be configured to apply release agent to substantially the entire axial length L of the pressure roller 44 for spreader modules used in the second imaging device of a serial duplex arrangement (FIG. 2). Alternatively, one or more release agent applicators 110 may be sized to apply release agent only to a portion or portions of the pressure roller that contacts the ink on the simplex side of the web. For example, the applicator 110 shown in FIG. 7 only extends a distance R that is approximately halfway across the length L of the pressure roller 44 for applying release agent to the half of the roller 44 that contacts the web strand $W_d$ with ink on the simplex side, such as along path 64 of FIG. 3. Other applicator sizes and multiple applicators may be used depending on the size and number of web strands or position of the ink on the simplex side of the web.

Figure 8:
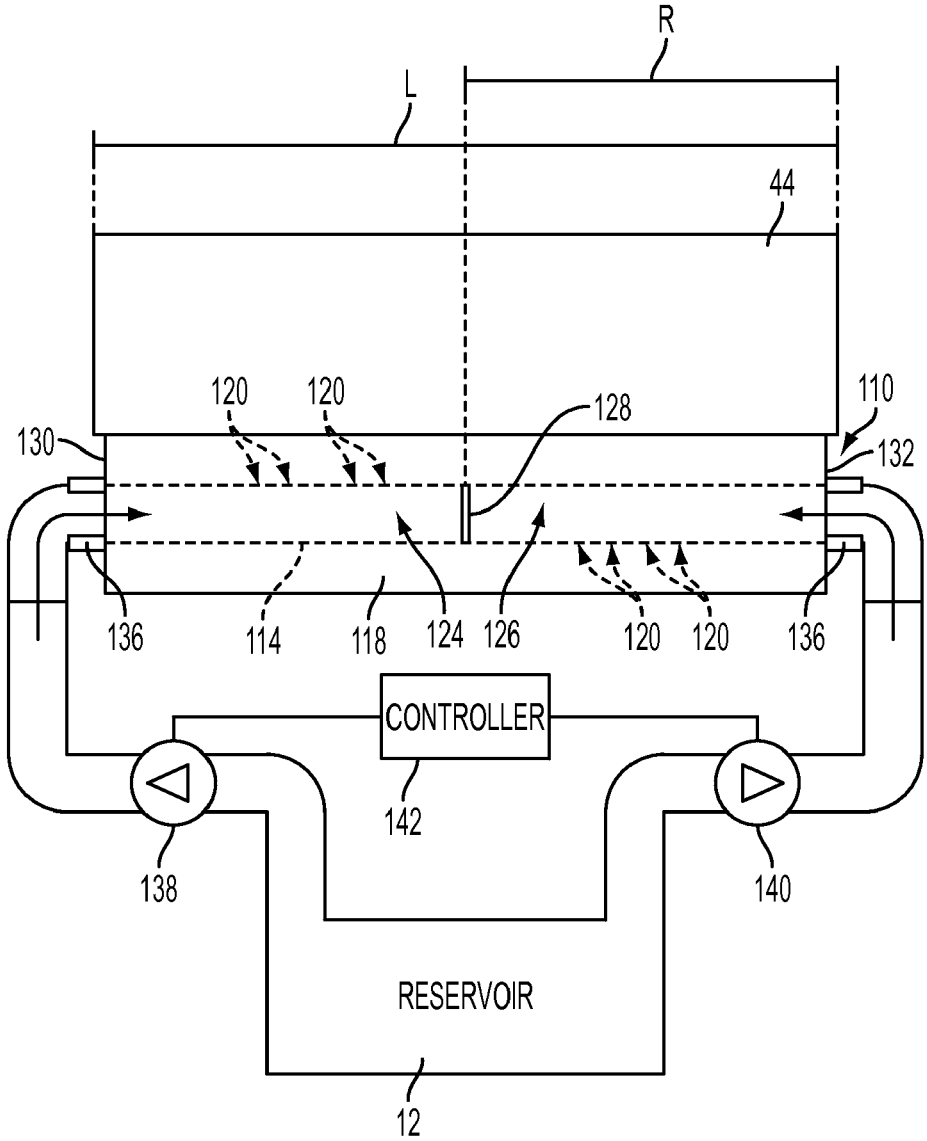
FIG. 8 is a schematic front view of yet another embodiment of a release agent applicator for use with the release agent sub-module of FIG. 5.

FIG. 8 shows a cross-sectional view of an embodiment of a release agent applicator 110' that may be used for the spreader modules 40 of both serial and mobius duplex printing arrangements. In particular, the release agent applicator 110' of FIG. 8 enables release agent to be selectively applied to substantially the entire length L of the pressure roller surface or to a desired portion of the length of the pressure roller 44 less than the entire length L of the pressure roller. The applicator 110 of FIG. 8 comprises a roller that includes a hollow cylindrical tube 114 and a foam outer delivery layer 118. The tube 114 is configured to receive release agent from a release agent reservoir 122. The tube 114 includes a plurality of small openings 120, referred to herein as perforations, through which release agent from the tube is allowed to escape to saturate the delivery layer. The foam delivery layer 118 may be formed of any suitable type of foam material which may be selected based on a number of factors such pore size and ability to retain release agent. The foam delivery layer is positioned to contact the pressure roller 44 surface to apply release agent thereto.

The cylindrical tube 114 has an axial length that corresponds to the length L of the pressure roller to which release agent is to be applied in the serial duplex arrangement. The tube 114 is divided into a first axial section 124 and a second axial section 126 by a wall 128 positioned at a predetermined location between the ends 130, 132 of the tube 114. The position of the dividing wall 128 in the tube 114 is selected so that one of the first axial section 124 and the second axial section 126 has a length R that corresponds to the length or portion of the pressure roller surface to which release agent is to be applied in a mobius duplex arrangement. For example, in the embodiment of FIG. 8, the wall 128 divides the tube 114 substantially in half so that release agent may be selectively applied to one half or the other half of the length of the pressure roller 44.

In one embodiment, a pumping system is configured to pump release agent into the tube 114 via the ends 130, 132 of the tube. To enable release agent delivery via the ends of the tube while permitting rotation of the tube 114, both ends 130, 132 of the tube include openings that are fluidly connected to rotating joints 136 that enable the tube 114 to rotate while providing a fluid path from each end to the respective sections of the tube for the release agent. The pumping system includes a first pump 138 for pumping release agent to the first axial section 124 and a second pump 140 for pumping release agent to the second axial section 126. Any suitable type of pumps may be utilized. The pumping system is controlled by a suitable control system 142 implemented in hardware, software, or both that enables the pumps 138, 140 to be selectively activated so that release agent may be delivered to the first axial section 124 only, the second axial section 126 only, or to both the first and the second axial sections 124, 126 simultaneously. The release agent delivery system such as pump rates, fluid path sizes and shapes, tube and perforation sizes, and foam roller diameter and pore size, may be tuned such that the amount of oil needed to on the pressure roll reaches an equilibrium state with the amount of oil supplied (internally) to the foam roll, thus eliminating the need for an oil recovery and/or filtering system.

Depending on whether the entire pressure roller 44 is to be oiled or just the first section or second section, release agent is pumped axially to appropriate sections 124, 126 of the tube. Once in the tube, the release agent exits the tube through the perforations 120 and into the foam roller. The release agent moves through the foam in a radial direction using capillary forces, and is then transferred to the pressure roller 44. Darcy's Law of fluid flow through a porous media is given by:

$$Q = \frac{-\kappa A}{\mu} \frac{(P_b - P_a)}{L}$$

Darcy's law states that the total discharge, Q (units of volume per time, e.g., $m^3/s$) is equal to the product of the permeability (κ units of area, e.g. $m^2$) of the medium, the cross-sectional area (A) to flow, and the pressure drop ($P_b - P_a$), all divided by the dynamic viscosity μ (in SI units e.g. kg/(m·s) or Pa·s), and the length L the pressure drop is taking place over. Thus, the flow rate (Q) is inversely proportional to the length (L) of the media, i.e, foam roller, in the direction of the flow rate. Now consider the path of the fluid as it travels from the center axis of the foam roll to the outer surface. The least resistant path for the fluid to travel is perpendicular to the axis of the roll because that is the shortest length (i.e. the radius of the roll) and thus this is where the highest flow rate (Q) will be found. Any deviation from perpendicular will result in the flow rate decreasing proportionally to the cosine of the skew angle (i.e. angle of deviation from perpendicular). These physics prevent oil from either section 124, 126 from significantly encroaching on another section.

Referring again to FIG. 5, the release agent sub-module 104 may be provided with a metering blade 114 positioned to meter release agent applied to the pressure roll 44 by the applicator 110. The metering blade 114 helps ensure that a uniform thickness of the release agent is present across the width of the pressure roller. The thickness of the layer of release agent metered onto the drum may be any thickness results in approximately 0.1-10 microliters of release agent being consumed per the equivalent of an 8½"×11" sheet. The release agent sub-module 104 may also include a cleaning blade (not shown) that is positioned with respect to the roller surface to scrape oil and debris from the roller surface. Although the release agent sub-module 104 has been described as having an applicator 110 in the form of a roller, any suitable type of applicator and method of supplying or delivering to the pressure roll may be used that enables the desired amount of release agent to be provided on the pressure roll surface.

In use, all spreader modules 40 for use with an imaging device, such as the imaging device of FIGS. 1-3, may be provided with the docking slot 100 for receiving a release agent sub-module 104. The release agent sub-module 104 does not have to be installed in spreader modules 40 of simplex printers or for the first printer 8*a* in a serial duplex architecture. To adapt an imaging device for use as second imaging device in a serial duplex arrangement as depicted in FIG. 2 or for use as a mobius printer as depicted in FIG. 3, a release agent sub-module 104 with the appropriate applicator (such as the applicator of FIG. 6 or 8 for serial arrangements or the applicators of FIG. 7 or 8 for mobius arrangements) is installed in the corresponding spreader module. If the selectable applicator 110' depicted in FIG. 8 is utilized, the control system may be programmed in a known manner so that release agent is applied to the desired portion of the pressure roller.

It will be appreciated that various embodiments of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An imaging device comprising:

a web transport system for transporting print media along a media path;

at least one printhead associated with the media path for emitting melted phase change ink, the melted phase change ink being deposited onto the print media to form images thereon;

a spreader module associated with the media path for spreading the melted phase change ink deposited onto the print media, the spreader module including:

a first roller for contacting the ink deposited onto the web by the at least one printhead;

a second roller arranged adjacent the first roller to define a pressurized nip through which the web is fed;

a release agent application system for applying release agent to the first roller; and a sub-module docking position arranged adjacent the second roller, the docking position being configured to releasably secure a release agent sub-module.

2. The imaging device of claim 1, further comprising:

a release agent sub-module installed in the docking position of the spreader module, the release agent sub-module including:

a release agent applicator for applying the second release agent to the second roller when the release agent-sub-module is installed in the docking position; and a release agent reservoir for supplying release agent to the release agent applicator.

3. The imaging device of claim 2, the release agent sub-module further comprising:

a metering blade for metering the release agent applied to the second roller.

4. The imaging device of claim 2, further comprising:

a midheater associated with the media path between the at least one printhead and the spreader module for heating the web to a spreading temperature.

5. The imaging device of claim 4, the spreading temperature being in a range from approximately 57° C. to approximately 75° C.

6. The imaging device of claim 5, the spreading nip being configured to generate a nip pressure of approximately 500 psi to approximately 2000 psi.

7. The imaging device of claim 2, the applicator comprising:

a hollow cylindrical tube surrounded by a foam delivery layer in contact with the second roller, the tube being divided into a first axial section and a second axial section by a wall that seals that first axial section from the second axial section, the tube having a first open end that fluidly couples the first axial section to a first release agent path and a second open end that fluidly couples the second axial section to a second release agent path, each of the first and second axial sections including a plurality of openings through which release agent escapes to saturate the foam delivery layer;

a release agent reservoir fluidly coupled to the first and second release agent paths;

a first pump for pumping release agent from the reservoir to the first axial section via the first release agent path, and a second pump for pumping release agent from the reservoir to the second axial section via the second release agent path; and a control system for selectively activating the first pump alone, the second pump alone, or both the first and second pumps simultaneously.

8. An imaging device comprising:

a first frame and a second frame arranged end to end with respect to each other, the first and the second frame each including:

a web transport system for transporting a continuous web of media along a web path and a plurality of a spreader module docking position;

at least one printhead mounted to the frame adjacent the web path and configured to deposit melted phase change ink onto the web to form images thereon;

a spreader module installed in the spreader module docking position, the spreader module including a housing, the housing including:

a spreader drum;

a pressure roller arranged adjacent the spreader drum to define a spreading nip through which the web is fed;

a release agent application system for applying a first release agent to the spreader drum; and a docking slot positioned adjacent the pressure roll, the docking slot being configured to releasably secure a release agent sub-module to the housing, the release agent sub-module for applying a second release agent to the surface of the pressure roller;

wherein the web transport system of the first frame is configured to receive a web of media from a media source and to transport the web with a first side facing the at least one printhead of the first frame;

wherein a web inversion system is positioned between the first frame and the second frame for inverting the web;

wherein the web transport system of the second frame is configured to receive the web from the inversion system and to transport the web with a second side of the web facing the at least one printhead of the second frame;

wherein the docking slot of the spreader module installed in the second frame includes a release agent sub-module releasably secured therein, the release agent sub-module for applying a second release agent to the corresponding pressure roll.

9. The imaging device of claim 8, the release agent sub-module including:

a release agent applicator for applying the second release agent to the pressure roller when the release agent-sub-module is installed in the docking slot; and a release agent reservoir for supplying release agent to the release agent applicator.

10. The imaging device of claim 9, the release agent sub-module further comprising:

a metering blade for metering the release agent applied to the pressure roller.

11. The imaging device of claim 10, further comprising:

a midheater mounted to each of the first and second frames along the web path between the at least one printhead and the spreader module for heating the web to a spreading temperature.

12. The imaging device of claim 11, the spreading temperature being in a range from approximately 57° C. to approximately 75° C.

13. The imaging device of claim 12, the spreading nip of the spreader modules being configured to generate a nip pressure of approximately 500 psi to approximately 2000 psi.

14. The imaging device of claim 9, the applicator comprising:

a hollow cylindrical tube surrounded by a foam delivery layer in contact with the pressure roller, the tube being divided into a first axial section and a second axial section by a wall that seals that first axial section from the second axial section, the tube having a first open end that fluidly couples the first axial section to a first release agent path and a second open end that fluidly couples the second axial section to a second release agent path, each of the first and second axial sections including a plurality of openings through which release agent escapes to saturate the foam delivery layer;

a release agent reservoir fluidly coupled to the first and second release agent paths;

a first pump for pumping release agent from the reservoir to the first axial section via the first release agent path, and a second pump for pumping release agent from the reservoir to the second axial section via the second release agent path; and a control system for selectively activating the first pump alone, the second pump alone, or both the first and second pumps simultaneously.

15. A spreader module for spreading liquid ink onto print media, the spreader module including:

a housing configured for insertion and removal from a spreader docking position of an imaging device frame;

a spreader drum operably supported in the housing;

a pressure roller operably supported in the housing adjacent the spreader drum to define a spreading nip through which a web of media is fed;

a release agent application system supported in the housing for applying a first release agent to the spreader drum; and a docking position adjacent the pressure roller, the docking position being configured to releasably secure a release agent sub-module within the housing, the release agent sub-module for applying release agent to the pressure roller.

16. The spreader module of claim 15, further comprising:

a release agent sub-module installed in the docking position of the housing, the release agent sub-module including:

a release agent applicator for applying the second release agent to the pressure roller when the release agent-sub-module is installed in the docking slot; and a release agent reservoir for supplying release agent to the release agent applicator.

17. The spreader module of claim 16, the release agent sub-module further comprising:

a metering blade for metering the release agent applied to the pressure roller.

18. The spreader module of claim 17, the spreading nip being configured to generate a nip pressure of approximately 500 psi to approximately 2000 psi.

19. The spreader module of claim 2, the applicator comprising:

a hollow cylindrical tube surrounded by a foam delivery layer in contact with the pressure roller, the tube being divided into a first axial section and a second axial section by a wall that seals that first axial section from the second axial section, the tube having a first open end that fluidly couples the first axial section to a first release agent path and a second open end that fluidly couples the second axial section to a second release agent path, each of the first and second axial sections including a plurality of openings through which release agent escapes to saturate the foam delivery layer;

a release agent reservoir fluidly coupled to the first and second release agent paths;

a first pump for pumping release agent from the reservoir to the first axial section via the first release agent path, and a second pump for pumping release agent from the reservoir to the second axial section via the second release agent path; and a control system for selectively activating the first pump alone, the second pump alone, or both the first and second pumps simultaneously.

* * * * *